US011957205B2

(12) United States Patent
Buono et al.

(10) Patent No.: US 11,957,205 B2
(45) Date of Patent: Apr. 16, 2024

(54) FOOTWEAR WITH TRACTION SOLE ASSEMBLY

(71) Applicant: SR Holdings, LLC, Waltham, MA (US)

(72) Inventors: Shannon E. Buono, Arlington, MA (US); Sean M. McDowell, Winchester, MA (US)

(73) Assignee: SR Holdings, LLC, Waltham, MA (US)

( * ) Notice: Subject to any disclaimer, the term of this patent is extended or adjusted under 35 U.S.C. 154(b) by 108 days.

(21) Appl. No.: 17/506,290

(22) Filed: Oct. 20, 2021

(65) Prior Publication Data

US 2023/0123448 A1 Apr. 20, 2023

(51) Int. Cl.
*A43B 13/18* (2006.01)
*A43B 13/22* (2006.01)

(52) U.S. Cl.
CPC ..... *A43B 13/181* (2013.01); *A43B 13/22* (2013.01)

(58) Field of Classification Search
CPC ... A43B 13/125; A43B 13/127; A43B 13/023; A43B 13/12; A43B 13/143; A43B 13/148; A43B 13/181; A43B 13/22
See application file for complete search history.

(56) References Cited

U.S. PATENT DOCUMENTS 4,551,930 A * 11/1985 Graham ..... A43B 5/06 36/114
5,224,279 A * 7/1993 Agnew ..... A43B 13/223 36/31
5,718,064 A * 2/1998 Pyle ..... A43B 13/187 36/28
6,266,896 B1 * 7/2001 Liu ..... A43B 13/12 36/28
6,516,539 B2 * 2/2003 Nishiwaki ..... A43B 7/144 36/35 R
6,685,011 B2 * 2/2004 Nishiwaki ..... A43B 13/181 36/28
7,225,564 B1 * 6/2007 Gillespie ..... A43B 3/30 36/35 R
7,712,229 B2 * 5/2010 Yang ..... A43B 13/181 36/29
7,946,058 B2 * 5/2011 Johnson ..... A43B 13/125 36/31
8,914,998 B2 * 12/2014 Gheorghian ..... A43B 13/141 36/103

(Continued)

*Primary Examiner* — Bao-Thieu L Nguyen
(74) *Attorney, Agent, or Firm* — Cook Alex Ltd.

(57) ABSTRACT

A footwear construction includes a sole assembly having a convoluted lower surface with multiple rolling peaks and valleys, and first and second midsoles having different durometers to provide dynamic stability, cushion and/or traction. The second midsole can include apertures that extend into some peaks so those peaks are compressible and conform well to underfoot terrain. The sole assembly can include certain lateral or medial peaks that transition to a perimeter of the sole assembly, and that are of a truncated shape with a sidewall to provide firmness and/or rigidity to the sole assembly around the perimeter. Other peaks can be disposed inward from the lateral or medial peaks and can be of a lesser firmness so those central peaks can provide cushioning and/or macro traction capabilities. A related method of manufacture also is provided.

20 Claims, 6 Drawing Sheets

(56) References Cited

U.S. PATENT DOCUMENTS 10,548,370 B2 * 2/2020 Walsh ..... A43B 13/185
10,874,169 B2 * 12/2020 Linkfield ..... A43B 13/28
11,576,467 B2 * 2/2023 Linkfield ..... A43B 13/16
2001/0032400 A1 * 10/2001 Brooks ..... A43B 23/22 36/102
2003/0226280 A1 * 12/2003 Paratore ..... A43B 9/18 36/4
2006/0277799 A1 * 12/2006 Lebo ..... A43B 13/141 36/102
2008/0060139 A1 3/2008 Mossbeck
2008/0229617 A1 * 9/2008 Johnson ..... A43B 3/0057 36/102
2010/0325917 A1 * 12/2010 Cass ..... A43B 13/187 36/28
2011/0179680 A1 * 7/2011 Miette ..... A43B 13/141 36/30 R
2013/0047474 A1 * 2/2013 Healy ..... A43B 13/187 36/30 R
2014/0130269 A1 * 5/2014 Dabah ..... A43B 13/181 12/142 R
2014/0196308 A1 7/2014 Baratta et al.
2016/0066649 A1 * 3/2016 Foley ..... B29C 66/131 156/380.5
2016/0157554 A1 * 6/2016 Adams ..... A43B 13/20 36/28
2017/0055719 A1 3/2017 Booska
2017/0238652 A1 * 8/2017 Langvin ..... A43B 13/141
2018/0077997 A1 * 3/2018 Hoffer ..... A43B 13/20
2019/0082781 A1 * 3/2019 Iuchi ..... A43B 13/04
2019/0261737 A1 * 8/2019 Walsh ..... A43B 13/18
2019/0289961 A1 * 9/2019 Iuchi ..... A43B 13/127
2020/0275739 A1 9/2020 Linkfield et al.
2020/0390188 A1 * 12/2020 Cass ..... A43B 13/184
2021/0315319 A1 * 10/2021 Klein ..... A43B 13/141
2021/0401113 A1 * 12/2021 Jensen ..... A43B 9/18

* cited by examiner

FOOTWEAR WITH TRACTION SOLE ASSEMBLY

BACKGROUND OF THE INVENTION

The present invention relates to footwear, and more particularly to footwear including a sole assembly having a convoluted lower surface to provide dynamic three dimensional traction, stability and/or cushioning.

A variety of different sole assemblies are used in footwear. Many sole assemblies include a midsole constructed from foam, and an underlying outsole, usually constructed from a sheet of rubber for durability and ease of assembly. The foam provides underfoot cushion, and the outsole provides traction. Many times, the outsole sheet includes multiple lugs integrally formed with the sheet in different locations for traction and wear resistance. The outsole rubber sheet and integral multiple lugs typically are constructed from a unitary, contiguous material. The sheet spans between the individual lugs so that the midsole is covered by the sheet. This can protect the midsole from damage, but also has some issues.

For example, the rubber sheet typically is heavy. Thus, all the material spanning between the individual lugs increases the overall weight of the footwear. For performance and hiking footwear, where every gram matters, this can impair the wearer's performance and prematurely tire the wearer and/or slow their pace. Further, with the sheet of material spanning between the individual lugs, the outsole is quite rigid. Thus, the individual lugs, projecting directly from the sheet, function as a large group, rather than as individual lugs. In turn, the individual lugs are prevented from reacting to and engaging underfoot surfaces, which can impair traction on the same.

With the common outsole sheet construction, the sole assembly may be less flexible, and can provide less cushioning. Further, it can be less able to conform to larger underfoot three dimensional contours and terrain. As a result, the sole assembly frequently does not provide acceptable proprioceptive feedback to the user regarding the contours and terrain, which can be detrimental to the user's balance and movement. Further, the above sole assembly may not provide macro traction very well, that is, traction on or over larger three dimensional objects and uneven surfaces, such as larger rocks, branches and other structures.

With the above conventional sole assembly, a user has to be mindful of different traction characteristics of their footwear on different types of terrain. For acceptable performance, the user need understand the underfoot feedback from the terrain, particularly where it varies a lot in three dimensions, to determine whether it is hard, soft or uneven, and what type of traction is therefore available for their activity using that particular footwear and sole assembly. From there, the user can adjust their movements and reaction on and to the terrain accordingly. If the user is inexperienced, or unfamiliar with terrain types, the user can inadvertently overestimate the amount of traction available, which can be detrimental to movement, balance and performance.

Accordingly, there remains room for improvement in the construction of sole assemblies to improve cushion, traction and function on different types of terrain, and to reduce the overall weight of the footwear for improved performance.

SUMMARY OF THE INVENTION

A footwear construction includes a sole assembly having a convoluted lower surface with multiple rolling peaks and valleys, and can include one or more midsoles having different durometers, to provide dynamic stability, enhanced cushioning and/or traction over three dimensional terrain.

In one embodiment, the footwear can include a first midsole constructed from a first material having a first durometer, and a second midsole constructed from a second material having a second durometer, the second durometer being less than the first durometer. The first midsole can be above the second midsole and can provide a stability platform for the user's foot. The softer second midsole can be located under the first midsole, and can cooperate with an outsole layer to provide enhanced macro traction over larger three dimensional underfoot objects and terrain features.

In another embodiment, the first midsole can be constructed from a first material that is a foam having a first durometer between 40 and 60 Asker C. The second midsole can be constructed from a second material that is a polyurethane having a second durometer between 20 and 40 Asker C.

In still another embodiment, the second midsole can include apertures that extend into some peaks so those peaks are compressible and conform well to underfoot terrain. The apertures can extend within the peaks so that less than 2 or 4 mm of the second material is disposed between an end of each aperture and a tip of each peak. With this construction, the peaks can be rendered more compliant and compressible, thereby providing more cushion or ability to conform to larger three dimensional underfoot terrain and objects and enhance traction.

In yet another embodiment, the sole assembly can include lateral and/or medial peaks that transition to a perimeter of the sole assembly on respective lateral and medial sides thereof. These lateral or medial peaks can be of a truncated shape and included in the outsole layer and/or the second midsole.

In even another embodiment, one or more of the lateral and medial peaks can include a second midsole outer sidewall. This sidewall can form a portion of the perimeter of the sole assembly on the lateral or medial sides. The sidewall can provide firmness and/or rigidity to the sole assembly around the perimeter.

In a further embodiment, the sole assembly can include inward or centrally disposed peaks. These peaks can be disposed inward from the lateral or medial peaks and can be of a lesser firmness. With this configuration, the centrally disposed peaks can provide cushioning and/or macro traction capabilities.

In still a further embodiment, the sole assembly can include different kinds of peaks. For example, there can be first peaks that have horizontally disposed, substantially circular cross sections that decrease in size as the peaks extend away from the first midsole. These first peaks can provide a first firmness. There also can be second peaks that have horizontal cross sections truncated by a second midsole outer sidewall. These second peaks can provide a second firmness that is greater than the first firmness along an outer perimeter of the second midsole. This can provide enhanced rigidity and firmness along the perimeter so the footwear is less prone to roll laterally or medially when worn by a user.

In even a further embodiment, the lateral and medial peaks can be partially spherical, can be truncated by the midsole sidewall and can further include a flattened and/or planar lower surface and/or ground contacting surface. This flat surface can provide more ground contact and increase firmness of those peaks to impair any lateral or medial roll of the footwear when worn by a user.

In yet a further embodiment, the first peaks can form a partially spherical shape. The second peaks can form a partially spherical shape that is itself truncated by a generally vertical sidewall. In some cases, the second peaks can be wrapped by an outsole sidewall that extends upward from a ground contacting surface of the outsole layer toward the first midsole. This outsole sidewall can add rigidity to the second peaks along the perimeter.

In even a further embodiment, a method is provided including: placing in a mold an outsole layer having a convoluted outsole upper surface including a plurality of peaks and a plurality of valleys; introducing a second midsole material over the convoluted upper surface to conform to or follow and bond with the convoluted outsole upper surface within the mold; defining a plurality of downwardly extending first apertures and a plurality of downwardly extending second apertures in the second midsole material, the first apertures extending toward the plurality of peaks; and curing the second midsole material to form a second midsole.

In another embodiment, the method can include joining a first midsole to an upper surface of the second midsole, the first midsole constructed from a first material that has a first durometer greater than a second durometer of the second midsole material forming the second midsole.

In still another embodiment, the method can include defining the first apertures so a thickness of the second midsole between a bottom of each aperture and the outsole layer is less than 3 mm.

The present footwear construction provides benefits in traction, cushion and stability that previously have not been achievable. The current sole assembly, with its convoluted lower surface having peaks and valleys can provide exceptional traction on three dimensional underfoot objects and terrain. Where included, the multi durometer midsoles can enhance the cushion provided through the sole assembly, allowing the outsole layer to quickly and efficiently conform to underfoot objects and absorb impact forces. The sole assembly also can react dynamically to different types of terrain, to provide macro traction as well as micro traction on slippery or wet surfaces when the outsole layer includes siping.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
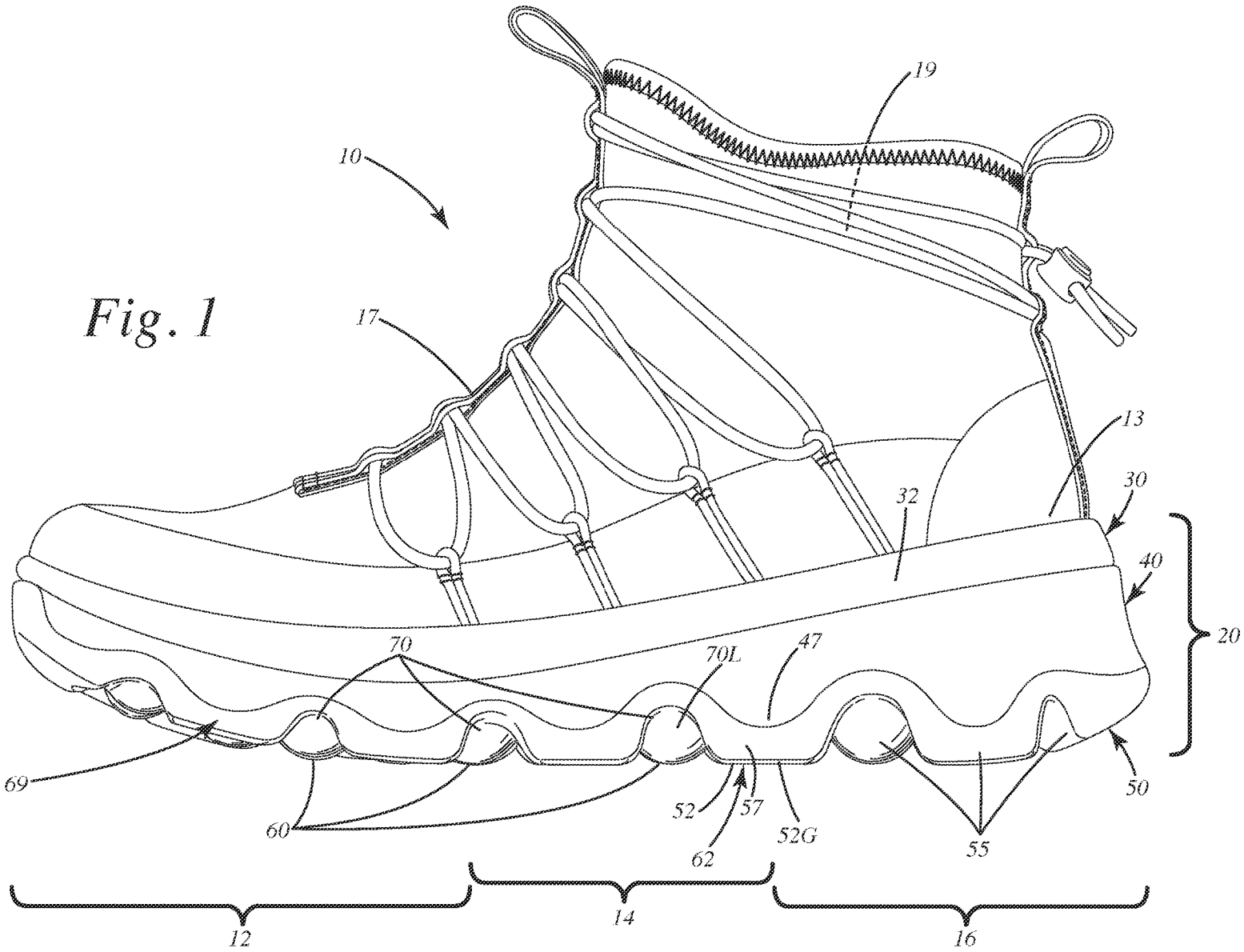
FIG. 1 is a side perspective view of footwear of a current embodiment including the sole assembly with a convoluted structure.

A current embodiment of the footwear is illustrated in FIGS. 1-7 and generally designated 10. In this embodiment, the footwear includes a sole assembly 20 including a first midsole 30, a second midsole 40 and an outsole layer 50, with a convoluted lower surface having an array of rolling peaks 60 and valleys 70. Although the current embodiment is illustrated in the context of a hiking shoe, the sole assembly thereof can be incorporated into any type or style of footwear, including performance shoes, trail shoes and boots, work boots, all-terrain shoes, athletic shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear.

Figure 2:
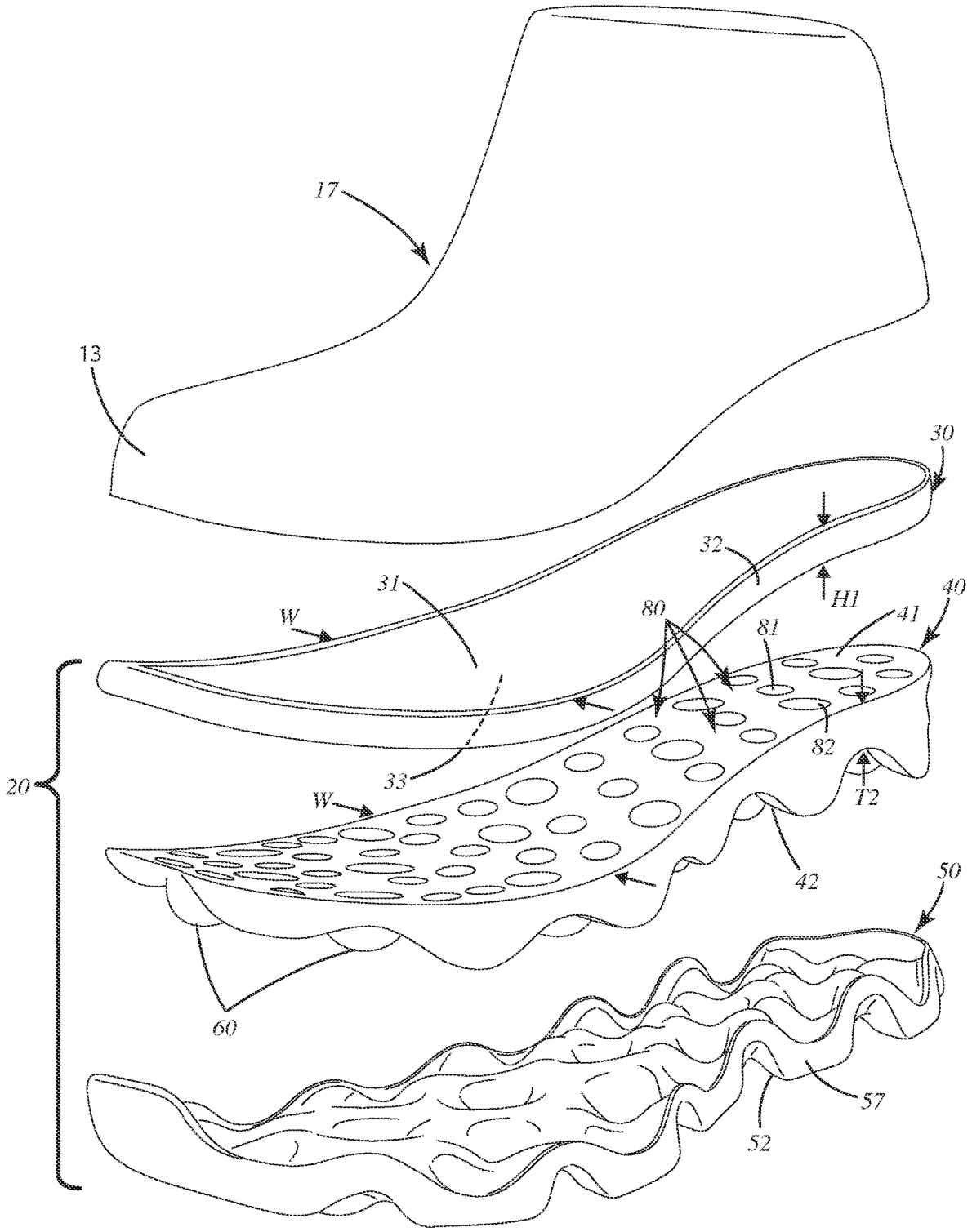
FIG. 2 is an exploded view of the footwear showing the various components.

With reference to FIGS. 1-2, the footwear 10 can include a sole assembly 20. The sole assembly 20 can include a first midsole 30 above a second midsole 40, an outsole layer 50 and a lower surface having a convoluted configuration with multiple peaks 60 and valleys 70 of a rolling, curved contour, optionally outfitted with siping 55. More or fewer elements of the sole assembly 20 can be included in some embodiments. The components of the sole assembly can individually and/or collectively provide the article of footwear 10 with a number of attributes, such as energy return, roll over, support, rigidity, flexibility, stability, cushioning, comfort, reduced weight, and/or other attributes. Generally, regardless of which components are present, the sole assembly 20 can form the bottommost portion of the footwear 10. The sole assembly 20 can include a side-to-side width W, a heel-to-toe longitudinal length L and a longitudinal axis LA, which can be shared with the footwear, sole assembly, first and second midsole platforms, plate and/or the outsole.

The footwear 10 can include a textile upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 17 can be constructed to improve the rigidity of the sole assembly 20. For example, the upper can be constructed from leather, plastic, canvas or other materials. The upper 17 can include one or more closure elements, including, for example, shoelaces (not shown). The upper 17 additionally includes an upper opening 19 for receiving the wearer's foot and a lower periphery 13 for attachment to the sole assembly 20.

A footbed (not shown) can be positioned within the void defined by the upper and can be non-stretchable and lightweight and joined to the upper to provide a void for receipt of the wearer's foot. The footbed can be constructed from a sheet of material, such as foam, EVA, PU, latex, gel or other materials, and by virtue of its compressibility, provide cushioning, and may also conform to the foot in order to provide comfort, support, and stability. The lower peripheral allowance or edge of the upper can be stitched, cemented, or otherwise fastened to the footbed around the perimeter of the footbed. The sole assembly 20 can be combined with any other type or style of upper construction capable of being suitably joined with it, for example, a Strobel construction. The joining of the sole assembly/outsole and the upper can be accomplished using adhesives, cement, injection molding, pour molding or any other technique used to join an upper and sole assembly.

With reference to FIGS. 1-5, the sole assembly 20 components will now be described in further detail. As mentioned above, the sole assembly 20 can include an outsole layer 50, as well as one or more midsoles, for example, a first midsole 30 and a second midsole 40 disposed between the upper 17 and the outsole layer 50. Optionally, the first midsole 30 can be constructed from a foam, such as ethyl vinyl acetate (EVA), and second midsole 40 can be constructed from a polymeric material, such as polyurethane (PU). Of course, other foams or polymeric materials can be selected for the midsoles.

The midsoles 30 and 40 also can be constructed to have different durometers to provide different performance characteristics. For example, the first midsole 30 can be constructed to be firmer and more rigid, to provide a relatively stable platform under the user's foot. The first platform can be constructed from a first material having a first durometer, optionally between 40 and 60 Asker C, between 40 and 50 Asker C, between 42 and 48 Asker C, between 44 and 45 Asker C, about 45 Asker C, or above about 40 Asker C. The second midsole can be constructed to be softer to provide more cushion and impact absorption and/or more compliant to provide macro traction to allow the outsole layer thereunder to better grip underfoot terrain and three dimensional objects. The second midsole can be constructed from a second material that has a second durometer optionally between 20 and 40 Asker C, between 30 and 40 Asker C, between 32 and 38 Asker C, between 35 and 38 Asker C, about 38 Asker C, or below about 40 Asker C. The first and second durometers can be different, optionally with the first durometer greater than the second durometer.

Figure 4:
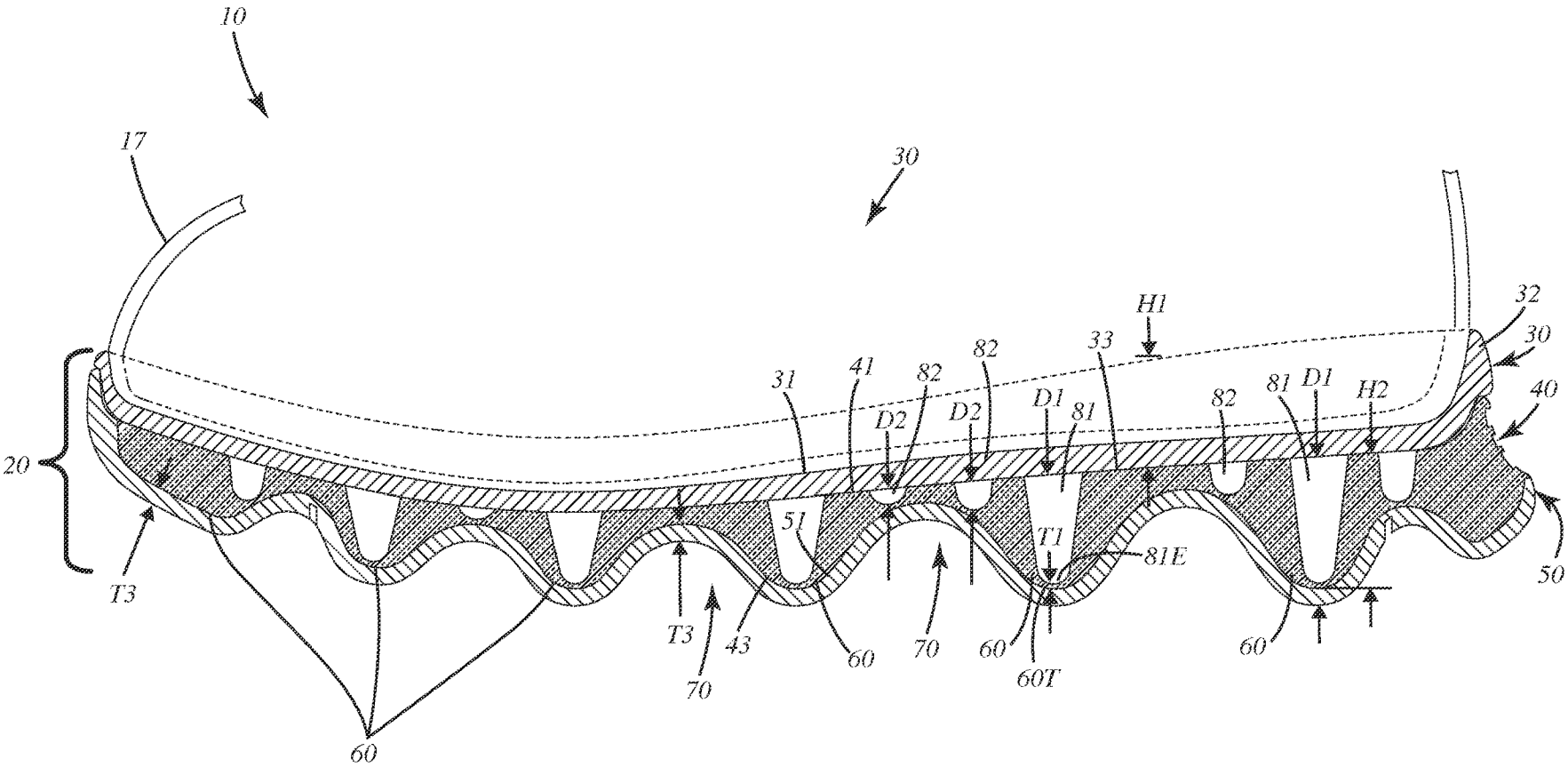
FIG. 4 is a section view of the sole assembly taken along lines IV-IV in FIG. 3.

Turning to the structure of the first midsole 30, with reference to FIGS. 2 and 4, it can include a first upper surface 31 that can be in the shape of the upper and is configured to outline a wearer's foot. The first upper surface 31 can be bounded at least partially by first upstanding midsole wall 32. This first upstanding midsole wall 32 can extend from the toe to the heel, becoming generally greater slightly in height H1 as it extends toward the heel region. In the heel region, the wall 32 can form a heel cup to add stability to the upper 17 and a wearer's heel when positioned in the upper. The first upstanding midsole wall 32 can extend upwardly adjacent a lower peripheral allowance of the upper 17, at least partially concealing that lower peripheral allowance 17A or lower portion of the upper 17. The upstanding midsole wall 32 can approximate a shape of a wearer's foot.

The first midsole 30 can include a first midsole lower surface 33 disposed opposite the first midsole upper surface 31 of the first midsole platform 30. This first midsole lower surface 33 can be substantially flat and/or planar across a majority of the width W of the sole assembly, and can be configured to be placed atop the second midsole 40 below it. The first midsole lower surface can be joined with the second midsole upper surface with cement, adhesive, glue, welding, molding or other elements or techniques.

Turning now to the second midsole 40, that component can include a second midsole upper surface 41 and a second midsole lower surface 43 opposite the second midsole upper surface. The second midsole can extend through the heel region then the arch region, and the lower surface 43 can be convoluted and can include a plurality of peaks 60 surrounded by a plurality of valleys 70 as described below. The second midsole upper surface can be generally flat and/or planar, but can undulate slightly to follow contours of a wearer's foot, for example, it optionally can include a raised arch portion and/or some slight concavity or convexity in the heel and/or forefoot in some applications, yet still be considered flat.

The second midsole upper surface 41 can define a plurality of downwardly extending apertures 80 that extend downward into the height or thickness H2 of the second midsole. The apertures 80 can include first apertures 81 and second apertures 82. Respective ones of the first apertures 81 can extend downward from the second midsole upper surface 41 into respective ones of the plurality of peaks 60 a first distance D1. This distance D1 can be selected so that the first apertures 81 extend within the plurality of peaks so that optionally less than 5 mm, less than 4 mm, less than 3 mm, less than 2 mm, less than 1 mm, or 0 mm of the second material is disposed between an end 81E of each aperture and a tip 60T of each peak 60. With this construction, the peaks generally can be rendered more compliant and compressible.

Figure 5:
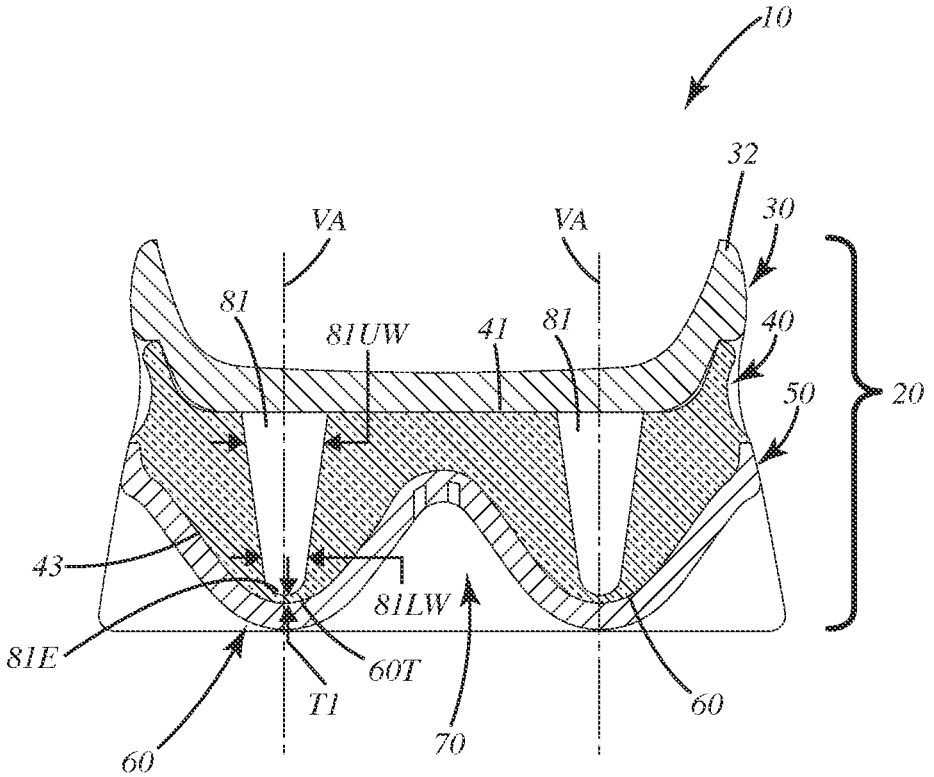
FIG. 5 is a section view of the sole assembly taken along lines V-V in FIG. 3.
Figure 6:
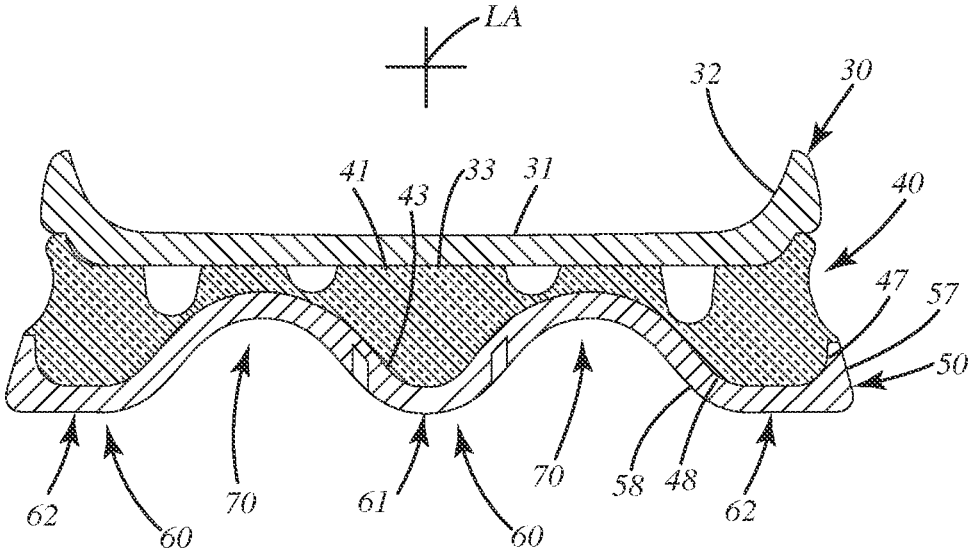
FIG. 6 is a section view of the sole assembly taken along lines VI-VI in FIG. 3.

The first apertures 81 optionally can be of a tapering shape such that their overall dimension decreases as the apertures extend away from the lower surface 33 of the first midsole or the upper surface 41 of the second midsole 40. Optionally, the first apertures 81 can be centered on a vertical axis VA of the respective first apertures 81 as shown in FIG. 5. As shown in FIGS. 4-5, the first apertures 81 can include an upper dimension or width 81UW and a lower dimension or width 81LW. The upper width 81UW can be greater than the lower width 81LW. The apertures, as further shown in FIG. 7, can be circular and partially frustoconical in shape. In this case, the respective widths can be diameters of the apertures.

As mentioned above, the first apertures 81 can extend downward to a lower end or termination location 81E. The lower end 81E can be closest to the outsole layer 50. This lower end 81E can be of a rounded, contoured flat, planar or other configuration depending on the application. As further mentioned above, there can be a thickness T1 between the end 81E and the tip 60T of the peak 60 of the second midsole 40. In some cases, the first apertures can extend all the way through the peak such that a hole is defined at the peak 60T. In that case, the outsole layer 50 can cover the hole, or further optionally can include a corresponding hole such that the first aperture 81 is in fluid communication with the environment.

Figure 7:
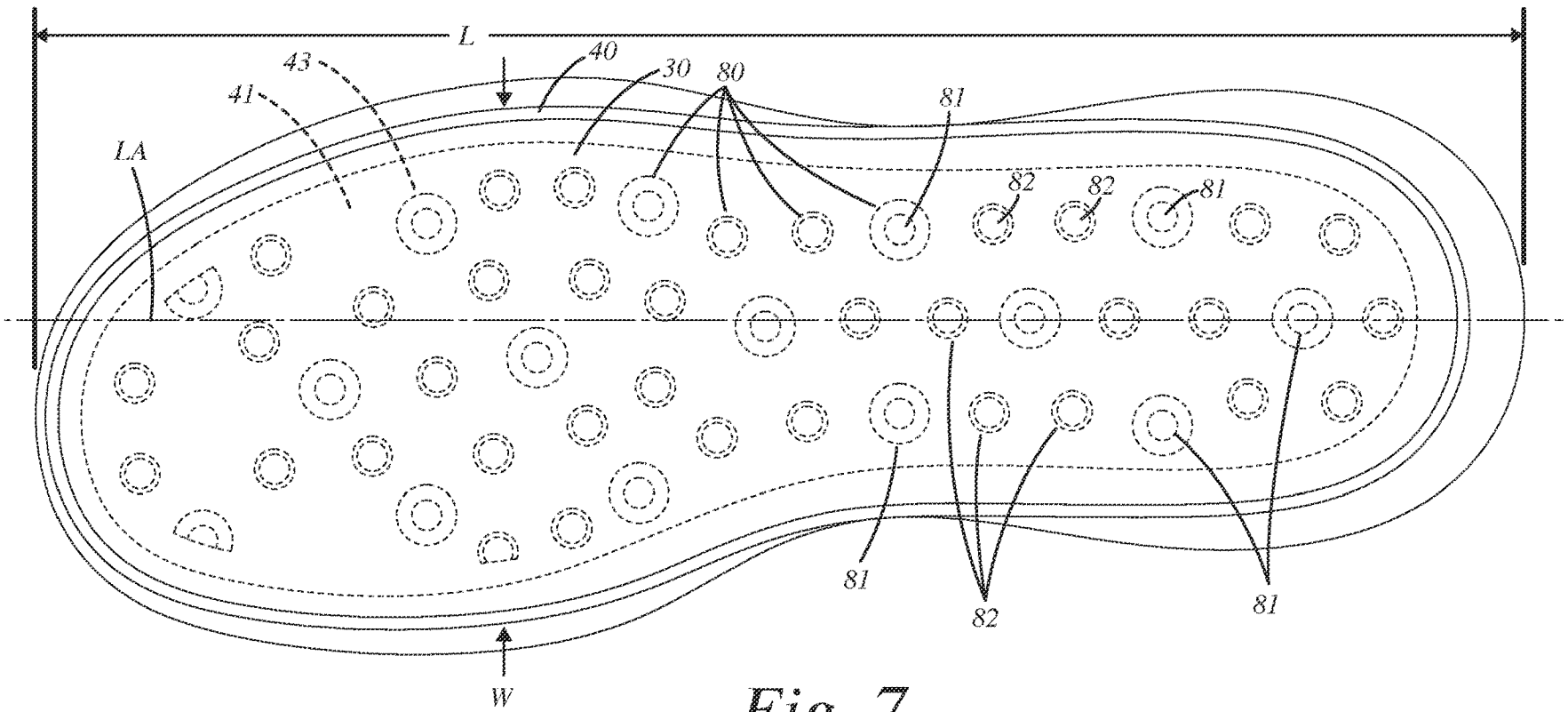
FIG. 7 is a top view of the sole assembly showing apertures in a first midsole concealed by a second midsole.

Returning to FIGS. 4 and 8, the midsole 40 optionally can include second apertures 82. These second apertures 82 can extend downward from the second midsole upper surface 41 toward the valleys 70 a second distance D2 that is less than the first distance D1 of the first apertures 81. The second apertures 82 also can be offset from the peaks 60. The second apertures can have similar frustoconical shapes and can include a rounded, flat, planar or other shaped end or bottom, similar to the first apertures end. The second aperture can have upper ends that open to the second midsole upper surface 41, as shown in FIGS. 4 and 7. Generally, the widths of the openings of the second apertures 82 can be smaller in size or dimension or diameter than the openings of the first apertures 81 at the second midsole upper surface.

The first and second apertures 81, 82 can be mixed and matched amongst one another in an array corresponding to the respective peaks and valleys. For example, as further shown in FIG. 7, the first apertures 81 can be aligned and uniformly spaced along the upper surface 41 in a pattern. The pattern can correspond to the peaks 60 of the convoluted lower surface of the sole assembly. The second apertures 82 can be interspersed in a pattern amongst the first apertures that are likewise in a pattern, generally corresponding to the valleys and the convoluted lower surface of the sole assembly 20.

With reference to FIGS. 1 and 4-6, as mentioned above, the lower surface of the sole assembly includes the convoluted shape including a plurality of peaks 60 and valleys 70. These peaks and valleys can be associated with the second midsole and/or the outsole layer that overlays the second midsole. As shown, the outsole layer 50 can follow the contours and undulations of the convoluted lower surface and can include corresponding peaks and valleys of the second midsole 40. The outsole layer 50 can be constructed from natural or synthetic rubber, thermoplastic polyurethane elastomers, nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection.

Optionally, as shown, the outsole layer 50 can be a generally thin, pliable, compliant and resilient layer. The outsole layer 50 can include a thickness T3 that extends between an outsole upper surface 51 and an outsole lower surface 52. This thickness T3 can optionally be between 0.5 mm and 10 mm, between 1 mm and 5 mm, between 12 mm and 4 mm, or about 3.5 mm, or less than 4 mm, or less than 5 mm. With these diminished thicknesses, the outsole layer 50 can be compliant such that the plurality of peaks 60, particularly the midsole material forming parts of the peaks, can compress to provide cushioning and or energy absorption upon being placed against an underfoot terrain object or three-dimensional surface. The diminished thickness of the outsole layer underfoot also can enable the outsole layer to conform readily to underfoot three-dimensional objects and/or terrain to promote macro traction, which is generally traction on larger three-dimensional underfoot objects encountered by the sole assembly 20.

Optionally, the outsole layer 50 can include siping 55, which can include a plurality of grooves, recesses or thin slots that extend across the outsole layer on the ground contacting surface 52. The siping can be in the form of particular shapes, such as sinusoidal or other waves, to provide enhanced traction on slippery footing, such as wet, icy, muddy, greasy or otherwise low friction services of objects in underfoot terrain. The siping generally can provide micro traction on smooth and/or slippery surfaces. The siping 55 can extend uniformly across the width W of the sole assembly 20 and can follow the three-dimensional contours of the convoluted lower surface, traveling up and down peaks and through respective valleys between the peaks. In some cases, the siping can extend upwardly along vertical sidewalls of the outsole layer around a perimeter 69 of the sole assembly 20 and/or the outsole layer 50 or midsoles 30 and 40.

As mentioned above and shown in FIGS. 3, 4-6, the second midsole 40 can include a second midsole lower surface that is convoluted and includes a plurality of peaks 60 surrounded by a plurality of valleys 70. The peaks 60 can have a variety of configurations and can include different types of peaks. For example, the peaks can include first peaks 61 which again can be formed from both the second midsole 40 as well as the overlaying outsole layer 50. The first peaks can be in the form of an at least partially spherical shape and/or contour. These first peaks 61 can be disposed closer to the longitudinal axis then a second type of peak 62 generally along the length L of the sole assembly. The partially spherical shape of the first peaks 61 can be a true partial sphere, such as a quarter, a third or a half of a sphere, but in other cases the partially spherical shape can be slightly parabolic in three-dimensions or of some other outwardly bulged or curved shape, again all of which can be referred to as a partially spherical shape.

Figure 3:
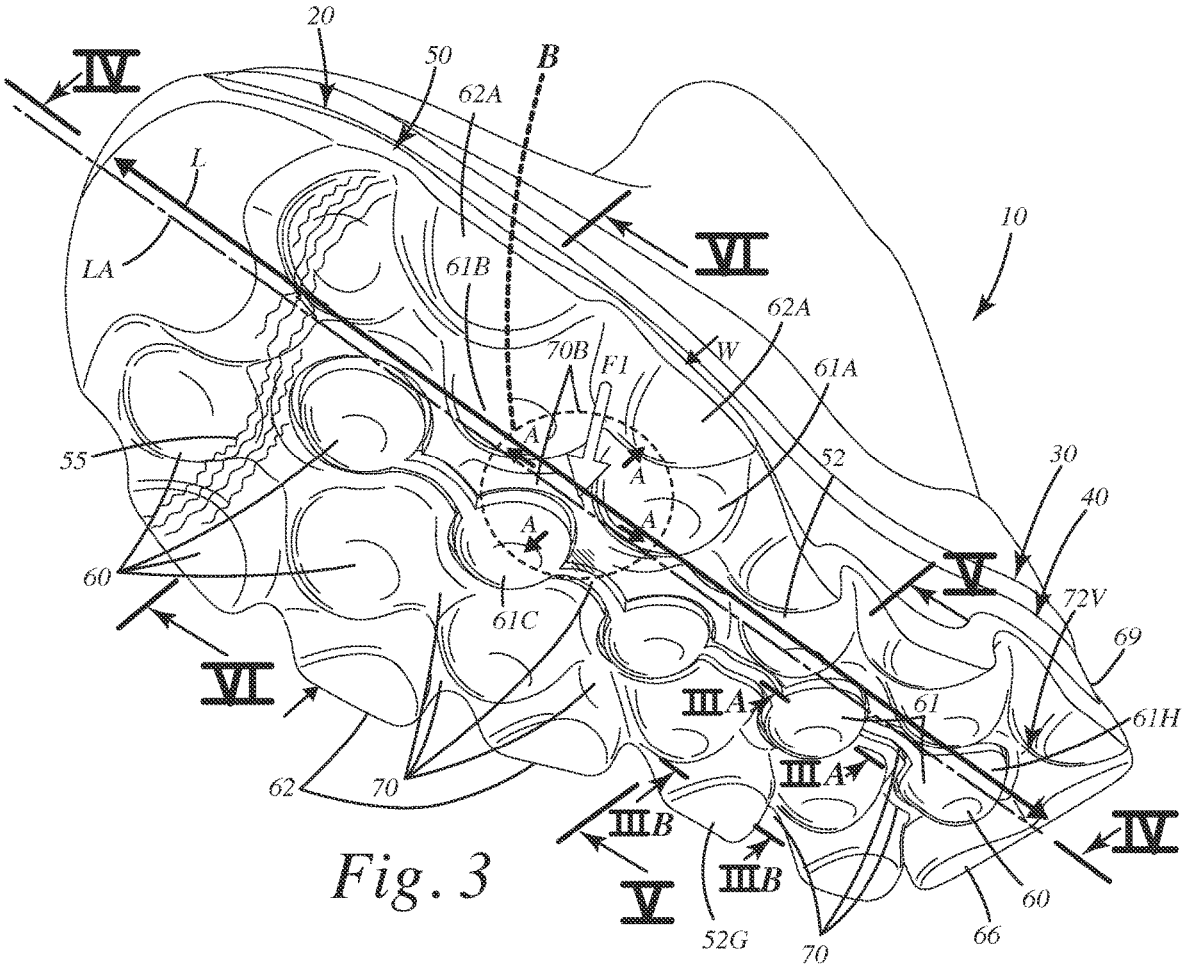
FIG. 3 is a bottom perspective view of the sole assembly showing the convoluted structure with rolling peaks and valleys of the sole assembly.
Figure 3A:
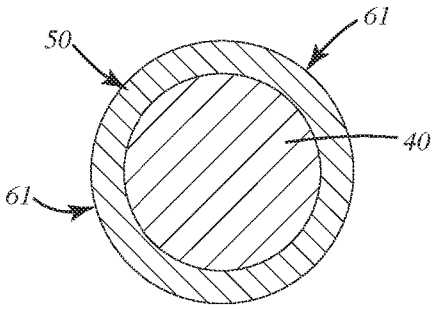
FIG. 3A is a cross section of a first type of peak.

The partially spherical shapes of the first peaks 61 can have certain horizontal cross-sections that decrease in size as the first peaks 61 extend away from the second midsole upper surface 41 or generally away from the first midsole 30. As shown in FIG. 3A, the first peaks 60 can include a substantially circular cross-section shown there. With the structure and configuration of the partially spherical shape, the first peaks 61 can provide a first firmness which can generally refer to the compressibility and deformation resistance of the first peaks when the sole assembly 20 contacts an underfoot object. This in turn can contrast a second firmness of second peaks 62 as described below, which can be of a second firmness that is greater than the first firmness along or adjacent an outer perimeter 69 of the second midsole, the outsole layer, and/or the sole assembly 20.

Optionally, a multitude of first peaks 61 can be aligned generally along the longitudinal axis LA of the footwear and can span the length L from the heel region 16 to the forefoot region 12 of the footwear. These aligned first peaks 61 can be of similar sizes. One of these first peaks 61 can be disposed in the heel region and can form a heel peak 61H that can be disposed directly under a heel of a user wearing the footwear 10 to provide cushioning at the heel.

As mentioned above, the sole assembly 20, the second midsole 40 and the outsole 50 can be configured to include multiple second peaks 62. The second peaks 62 can be disposed outwardly relative to the longitudinal axis LA and relative to the inwardly disposed first peaks 61 as shown further in FIGS. 3, 3B and 6. The second peaks 62 can be in the form of truncated partially spherical elements and can be positioned adjacent or at the perimeter 69 of the sole assembly 20 to provide a second firmness that is greater than the first firmness along that perimeter of the sole assembly second midsole and/or outsole layer. This second firmness can provide greater lateral and medial stability around the outer perimeter of the footwear. In turn, this can provide enhanced stability and impair rolling of a user's foot disposed in the footwear 10.

Figure 3B:
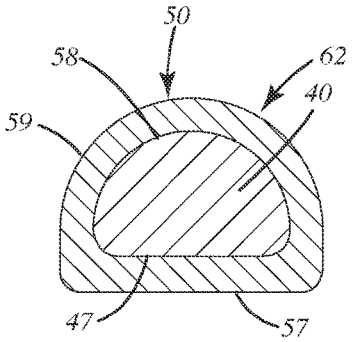
FIG. 3B is a cross section of a second type of peak.

As shown in FIG. 3B, the second peaks 62 can include a horizontal cross-section that is truncated by a second midsole outer side wall 47 and/or a second outsole sidewall 57. These sidewalls 47 and 57 can be disposed farther from the longitudinal axis than a curved second midsole inner wall 48 or a curved inner outsole wall 58. These inner walls as shown can follow the partially spherical contour and/or and can be partially or fully rounded and/or curved. In some cases these inner walls can be more angular. Further optionally, the second peaks 62 can extend downward to a ground contacting surface 52G that is substantially flat and/or planar. This flat and/or planar surface can be repeated amongst multiple second peaks 62 that are disposed around the periphery 69 of the sole assembly. These flat ground contacting surfaces in this area can impair rolling of the footwear and can enhance lateral and medial stability of the sole assembly 20 for a user.

The second peaks 62 optionally can be wrapped at least partially by the outsole sidewall 57 extending around it. This sidewall 57 can extend upwardly from the ground contacting surface of the outsole layer 50 toward the first midsole 30. This outsole sidewall 57 can add rigidity to the second peaks 62 and also can increase the second firmness of those peaks around the perimeter 69. In some cases, the outsole sidewall 57 can be thicker than the thickness T3 of the outsole layer overlaying the first peaks 61 to provide such enhanced firmness and/or rigidity. In other applications, the outsole sidewall can be absent from the construction, and the midsole outer sidewalls can be fully exposed to the environment.

As shown can FIG. 1, the valleys along the perimeter 69 of the sole assembly 20 can transition to and from the respective peaks 60. The valleys can include in some cases a lateral valley 70L that transitions to a second midsole outer sidewall 47. The outer sidewall 57 of the outsole layer can be joined with one or both of the lateral valley 70L and the second midsole outer sidewall 47. In some cases, the outsole sidewall 57 can extend upwardly from a flat, generally planar lower ground contacting surface 52G of one or more of the respective second peaks 62.

Optionally, the second peaks can include a contact heel pad 66 that can be substantially flat and/or planar on its ground contact surface, such that the pad 66 can function as a heel strike pad. The heel peak 61H, which again can be partially spherical, can be surrounded by a portion of the heel contact pad 66 and the heel region. The peak 61H can be separated from the contact heel pad by a heel pad valley 72V as shown in FIG. 3. In other applications, the peak 61H and pad 66 can be integrally formed in a different configuration.

The various peaks 60 can function to provide enhanced cushion and macro traction over large three-dimensional objects in underfoot terrain. As an example, the sole assembly 20 can be configured to absorb forces F1 exerted by the ball B of a user's foot on the sole assembly. In particular, the peaks 60 can be configured so that first peaks 61A, 61B and 61C, as well as a second peak 62A can surround or circumferentiate a valley 70B that corresponds to the ball B of the user's foot. When a force F1 is exerted by the ball B on the sole assembly, it is translated to the first valley 70B under the ball B. In turn, the first, second, third and fourth peaks can deflect away from the first valley 70B in the direction of the arrows A to provide cushioning to the ball B of the user's foot. The various peaks 60 also can be arranged in different arrays and configurations to provide impact absorption, cushioning and/or other types of traction depending on the application.

A method of making the footwear 10 and sole assembly 20 in particular will now be described. In general, the method can include: placing an outsole layer in a mold, the outsole layer having a convoluted outsole surface including multiple rolling peaks and valleys; introducing a second midsole material over the convoluted outsole surface, which optionally can be an upper surface of the outsole; defining downwardly extending apertures in the second midsole material, with some apertures extending toward the peaks; curing the second midsole material to form a second midsole; and optionally joining a first midsole to an upper surface of the second midsole. Further optionally the first midsole can be constructed from a first material that has a first durometer greater than a second durometer of the second midsole material.

Before the outsole layer is placed in the mold, it can be molded and formed with tread such as siping. The various valleys and peaks of the convoluted surface also can be formed in the molding operation of the outsole layer, along with any outsole sidewalls around the perimeter of the outsole layer. The outsole layer can be appropriately trimmed and shaped before placement in the mold to ensure a proper fit and processing.

When the second midsole material is introduced in the mold, another mold plate or portion can interact with the second material to define the respective first and second apertures described above, corresponding to respective peaks and valleys. After the second midsole and outsole layer are joined, the first midsole 30 likewise can be joined to the second midsole 40 to complete the sole assembly with all these components. With the sole assembly 20 completed, the upper 17 can be joined with the sole assembly and further trimming and processing can be performed to complete the footwear 10.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A footwear construction comprising:

a first midsole constructed from a first material having a first durometer, the first midsole including a first midsole upper surface configured to face toward a user's foot placed within the footwear construction, and an opposing first midsole lower surface;

a second midsole constructed from a second material having a second durometer, the second durometer being less than the first durometer, the second midsole including a second midsole upper surface that is joined with the first midsole lower surface, the second midsole upper surface defining a plurality of downwardly extending first apertures and downwardly extending second apertures, the second midsole upper surface directly joined with the first midsole lower surface around an upper end of each of the first and second apertures such that the first midsole lower surface closes the first and second apertures, the second midsole having a second midsole lower surface that is convoluted and includes a plurality of peaks surrounded by a plurality of valleys, the plurality of first apertures extending downward from the second midsole upper surface into the plurality of peaks a first distance, the plurality of second apertures extending downward from the second midsole upper surface toward the valleys a second distance, the plurality of peaks comprising:

a plurality of first peaks that have substantially circular cross sections in a lateral direction of the footwear and substantially circular cross sections in a longitudinal direction of the footwear that decrease in size as the first peaks extend away from the first midsole so that the first peaks provide a first firmness, the plurality of first peaks being downwardly extending away from the second midsole upper surface, and a plurality of second peaks that have horizontal cross sections truncated by a second midsole outer sidewall so that the second peaks provide a second firmness that is greater than the first firmness along an outer perimeter of the second midsole; and an outsole layer disposed over the plurality of first peaks, the plurality of second peaks, the plurality of valleys and the second midsole outer sidewall.

2. The footwear construction of claim 1, wherein the first material is a foam having the first durometer between 40 and 50 Asker C, wherein the second material is a polyurethane having the second durometer between 30 and 40 Asker C.

3. The footwear construction of claim 1, wherein the first plurality of apertures extend within the plurality of peaks so that less than 2 mm of the second material is disposed between a lowermost end of each aperture and a tip of each peak, whereby each peak is rendered more compliant and compressible.

4. The footwear construction of claim 1, wherein each of the plurality of first peaks form a partially spherical shape, wherein the outsole layer extends into and covers each of the plurality of valleys, wherein the plurality of second peaks are wrapped by an outsole sidewall that extends upward from a ground contacting surface of the outsole layer toward the first midsole, whereby the outsole sidewall adds rigidity to the plurality of second peaks.

5. The footwear construction of claim 4, wherein the plurality of valleys includes a lateral valley that transitions to the second midsole outer sidewall, wherein the outsole sidewall is joined with at least one of the lateral valley and the second midsole outer sidewall.

6. The footwear construction of claim 1, wherein the second midsole sidewall of each of the plurality of second peaks is disposed opposite a curved contour disposed inward from the second midsole sidewall and closer to a longitudinal axis of the footwear than the second midsole sidewall.

7. The footwear construction of claim 6,
wherein the plurality of first peaks form at least a partial spherical shape and are disposed closer to the longitudinal axis than the plurality of second peaks.

8. The footwear construction of claim 1,
wherein the outsole layer includes siping,
wherein the outsole layer is between 1 mm and 5 mm in thickness, whereby the outsole layer is compliant such that the plurality of peaks can compress to provide cushioning.

9. The footwear construction of claim 1,
wherein the plurality of peaks includes a contact heel pad that is substantially flat,
wherein the plurality of first peaks includes a heel peak that is partially spherical and surrounded by a portion of the contact heel pad, but separated from the contact heel pad by a heel pad valley.

10. A footwear construction comprising:
a first midsole including a first midsole upper surface configured to face toward a user's foot placed within the footwear construction, and an opposing first midsole lower surface;
a second midsole including a second midsole upper surface that is below the first midsole lower surface, the second midsole upper surface defining a plurality of downwardly extending first apertures and a plurality of downwardly extending second apertures, the second midsole upper surface directly joined with and engaging the first midsole lower surface around an upper end of each of the plurality of first apertures such that the first midsole lower surface closes the upper end of the plurality of first apertures, the second midsole having a second midsole lower surface that is convoluted and includes a plurality of peaks surrounded by a plurality of valleys, the plurality of first apertures extending downward from the second midsole upper surface into the plurality of peaks a first distance, the plurality of second apertures extending downward from the second midsole upper surface toward the valleys a second distance that is less than the first distance; and
an outsole layer disposed over and following the convoluted second midsole lower surface, the plurality of peaks and the plurality of valleys,
wherein each of the plurality of peaks is downwardly extending, and includes a curvature as each peak transitions to a respective valley,
wherein the outsole layer extends downward along the curvature of a respective peak of the plurality of peaks and through a respective valley of the plurality of valleys, the outsole layer being disposed in the respective valley and transitioning from a first peak to a second peak of the plurality of peaks on opposing sides of the respective valley.

11. The footwear construction of claim 10,
wherein the plurality of peaks include a plurality of first peaks that have substantially circular cross sections in a lateral direction of the footwear and substantially circular cross sections in a longitudinal direction of the footwear that decrease in size as the peaks extend away from the first midsole so that the plurality of first peaks provide a first firmness,
wherein the plurality of peaks include a plurality of second peaks that have horizontal cross sections truncated by a second midsole outer sidewall so that the second peaks provide a second firmness that is greater than the first firmness along an outer perimeter of the second midsole, whereby the second firmness provides greater lateral stability around the outer perimeter to a user's foot disposed in the footwear construction.

12. The footwear construction of claim 11, comprising:
a first peak,
a second peak,
a third peak, and
a fourth peak surrounding a first valley configured to extend under a ball of a user's foot disposed in the footwear construction,
wherein the first, second, third and fourth peak are configured to deflect away from the first valley when the ball of the user's foot exerts a force on the second midsole, whereby the first, second, third and fourth peaks provide cushioning to the ball of the user's foot.

13. The footwear construction of claim 10,
wherein the first plurality of apertures extend within the plurality of peaks so that less than 2 mm of the second midsole is disposed between a lowermost end of each aperture and a tip of each peak, whereby each peak is rendered more compliant and compressible.

14. The footwear construction of claim 10,
wherein the plurality of first apertures include an aperture centered on a vertical axis of a first peak extending downward into the first peak to a termination location such that the first peak includes a downward extending thickness below the termination location of less than 2 mm.

15. The footwear construction of claim 14,
wherein the outsole layer includes siping and extends over the convoluted second midsole lower surface to conform to the plurality of peaks and the plurality of valleys,
wherein the siping extends over a first peak, into a first valley and over a second peak.

16. A footwear construction comprising:
a first midsole including a first midsole upper surface configured to face toward a user's foot placed within the footwear construction, and an opposing first midsole lower surface;
a second midsole including a second midsole upper surface that is below the first midsole lower surface, the second midsole upper surface defining a plurality of downwardly extending first apertures and a plurality of downwardly extending second apertures, the second midsole upper surface being attached to the first midsole lower surface around the first apertures, the second midsole having a second midsole lower surface that is convoluted and includes a plurality of peaks that are downwardly extending, the plurality of peaks being surrounded by a plurality of valleys, the plurality of first apertures extending downward from the second midsole upper surface below the valleys and into the plurality of peaks a first distance, the plurality of second apertures extending downward from the second midsole upper surface toward the valleys a second distance the plurality of first apertures extending below the plurality of valleys surrounding each first aperture; and
an outsole layer being secured to the convoluted second midsole lower surface and directly joined to the plurality of peaks and to the plurality of valleys to cover the second midsole.

17. The footwear construction of claim 16,
wherein each of the plurality of peaks has a substantially circular cross section in a lateral direction of the footwear and a substantially circular cross section in a longitudinal direction of the footwear.

18. The footwear construction of claim 16, wherein the second midsole upper surface is adhered to the first midsole lower surface around the plurality of first apertures and the plurality of second apertures.

19. The footwear construction of claim 16, wherein the first distance is greater than the second distance.

20. The footwear construction of claim 16, wherein the plurality of peaks include a first peak having a first cross section in a lateral direction of the footwear and a second peak, distal form the first peak, having a second cross section in a lateral direction of the footwear, wherein the first cross section is a substantially circular cross section taken horizontally, along a horizontal plane, wherein the second cross section, taken horizontally along the horizontal plane, is rounded in a first section and truncated by a flat midsole side wall in a second section.

* * * * *